United States Patent [19]

Conway

[11] Patent Number: 4,477,048

[45] Date of Patent: Oct. 16, 1984

[54] PAD HOLDER AND DISPLAY

[76] Inventor: Gerald A. Conway, 3133 Fairfax Rd., Cleveland, Ohio 44118

[21] Appl. No.: 303,897

[22] Filed: Sep. 21, 1981

[51] Int. Cl.[3] ..... A47B 23/00

[52] U.S. Cl. ..... 248/447.1; 40/10 R; 40/11 R; 248/444.1

[58] Field of Search ..... 248/441 B, 441 A, 221.4, 248/467, 220.3; 40/10 R, 11 R; 206/526

[56] References Cited

U.S. PATENT DOCUMENTS

| | | | |
|---|---|---|---|
| 1,687,859 | 10/1928 | Fontaine | 40/10 R |
| 2,647,711 | 8/1953 | Margulis | 248/467 |
| 2,809,001 | 10/1957 | Margulis | 248/467 |
| 2,935,804 | 5/1960 | Duckro | 40/10 R |
| 3,052,436 | 9/1962 | Margulis | 248/467 |
| 3,169,330 | 2/1965 | Deuchar | 40/11 R |
| 3,633,865 | 1/1972 | Hogg | 248/467 |
| 3,642,147 | 2/1975 | Voorhies | 211/181 |
| 4,016,977 | 4/1977 | Krautsack | 248/467 |
| 4,138,019 | 2/1979 | Smith | 248/220.3 |
| 4,189,053 | 2/1980 | Stagnitto et al. | 206/526 |

*Primary Examiner*—William H. Schultz
*Assistant Examiner*—Ramon O. Ramirez
*Attorney, Agent, or Firm*—Maky, Renner, Otto & Boisselle

[57] ABSTRACT

A point of purchase flexible pad holder and display includes an upper clear plastic section which may snap into a pricing channel or be suspended from a peg and a lower separable double-sided, front and back, adhesive section with the front of such section being employed to secure a tear-off pad while the back may secure the holder as a whole or separated in a variety of display locations. The connection and structure of the two sections enables stable support of the pad, ease of insertion into the pricing channel, and also ease of clean separation of the two sections. The back may also secure a second pad so that when the first is exhausted the holder need merely be turned around on the pricing channel or peg to present the second pad to the purchaser.

14 Claims, 6 Drawing Figures

PAD HOLDER AND DISPLAY

This application relates generally to a pad holder and display and more particularly to a point of purchase flexible pad holder and display which is economical of manufacture and which has wide application in point of purchase of displays, advertising and the like.

BACKGROUND OF THE INVENTION

In point of purchase display and advertising it is common to offer the purchaser such things as recipes, instructions, coupons or other promotional material. These are commonly afforded in the form of a tear-off pad which is simply a pad of sheets of paper which may readily be removed one at a time. However, positioning and securing the pad in the proper display location presents a significant problem. Many grocery stores or drug stores, for example, utilize pricing channels in which the pricing of various items displayed on the shelves may be positioned and replaced. Other such applications may, for example, be on aperture boards, bulletin boards, shelf displays without the pricing channel, and cut box displays. Since most such flexible pad holders are throw-away items, once the pad is depleted, it is important that the holder and display be of inexpensive construction and yet have wide application in the various formats where the display may be required.

One of the principle applications for such flexible pad display is in connection with pricing channels. If used in such application, it is important that the display be firmly secured in the pricing channels so that the purchaser may remove one sheet of the display without dislodging the entire display from the pricing channel. Thus, the flexible pad holder should be supported with stability from the pricing channel. It is also important that the flexible pad be supported in a manner not to obscure the pricing channel or any information contained thereon. Since pricing and other information in pricing channels is all too frequently replaced, it is important that adhesive not be applied directly to the inside surfaces of the pricing channel.

Since such displays may have other applications such as in the noted bulletin board, aperture board, or cut box displays, it is important that the portion of the display holder designed to secure it to a pricing channel be readily and easily removable if unwanted.

Some forms of relatively complex display holders suffering from some of the drawbacks noted above may be seen in prior U.S. Pat. Nos. 4,016,977, 2,647,711, and 2,755,276.

SUMMARY OF THE INVENTION

The present invention relates to a flexible pad holder and display which includes an upper section and a lower section with the upper section including a central downwardly projecting tab, having a horizontal lower edge, adapted to be flexed out of the plane of the holder to snap into a pricing channel in cooperation with the top edge. The lower section is then supported pendently from the upper section by the lateral portions of the upper section on each side of the central tab.

The lower section includes a rectangular adhesive pad so that the flexible pad may be secured thereto thus to be supported in pendent fashion from the pricing channel. The lower section may include such adhesive pads on both sides so that two oppositely facing pads may be secured to the lower section of the holder. In cooperation with the lower edge of the tab, the holder is provided with weakening slits so that the lower section may readily be removed from the upper section and with adhesive pads on both sides, the flexible pad may then be secured on any desired position on a bulletin board, display shelf without the pricing channel, or a cut box display, for example. The upper section of the holder may be provided with a hole so that the holder and the flexible pad secured thereto may be suspended from a peg. The holder being in essence a throw-away item, is inexpensive to manufacture. The upper section of the holder also is preferably transparent so as not to obscure any information appearing therebehind. Alternatively, the upper portion may be provided with additional informational display material.

DETAILED DESCRIPTION OF THE PREFERRED EMBODIMENT

Figure 1:
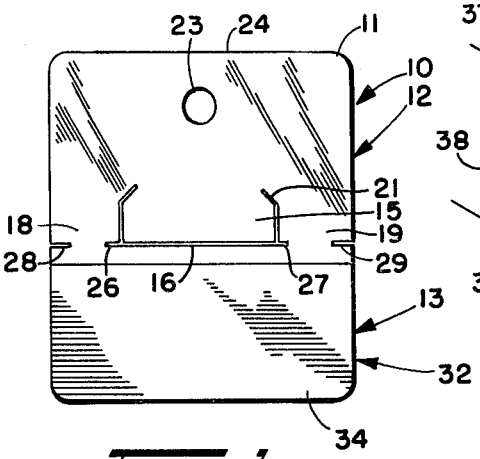
FIG. 1 is a plan view substantially full size of a flexible pad holder and display in accordance with the present invention.
Figure 2:
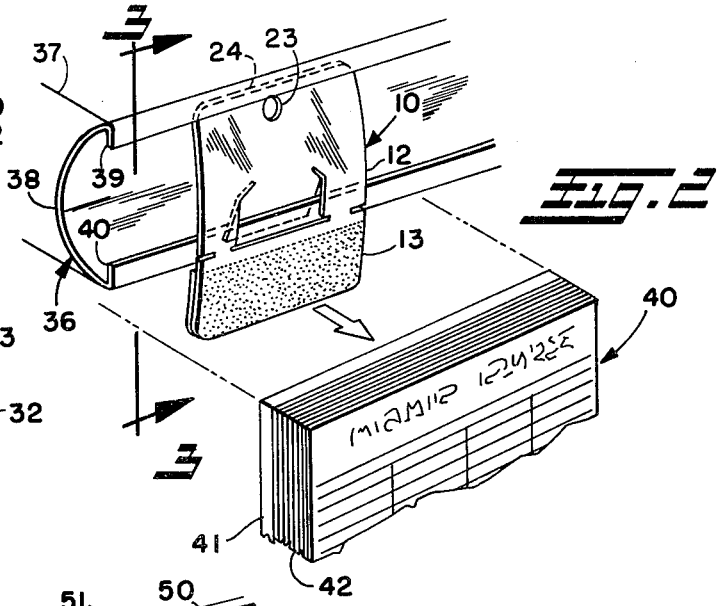
FIG. 2 is a perspective view of such flexible pad holder and display shown mounted on a pricing channel.
Figure 3:
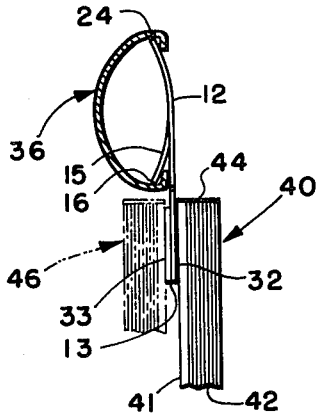
FIG. 3 is an end or edgewise view of the flexible pad holder and display mounted in the pricing channel as seen from the line 3—3 of FIG. 2.

Referring first to FIGS. 1 through 3, it will be seen that the flexible pad holder and display of the present invention comprises a generally square or rectangular sheet of flexible transparent plastic material shown at 10. While the sheet is fairly rigid, it is nonetheless flexible from its plane of major extent. Also, the sheet may be slightly longer in the vertical dimension than it is in its horizontal dimension. The sheet includes rounded corners 11 as indicated and an upper section 12 and a lower section 13.

The upper section includes a central downwardly projecting tab seen at 15 which is die cut into the sheet 10 and has a lower horizontal edge 16. The lower edge of the tab 16 extends well over half the width of the sheet and the tab forms two lateral or side legs 18 and 19 which integrally connect the upper section 12 with the lower section 13.

The lateral edges of the tab which may be die cut from the sheet include an upwardly inwardly directed angular portion seen at 21 which reduces the integral connection of the tab with the main body of the sheet at the upper end of the tab thus enhancing the flexibility or ability to deflect the tab from the plane of the sheet while maintaining the lower edge 16 of substantial width. The angled edge of the tab also assists in maintaining the planarity of the sheet when the tab is deformed as seen more clearly in FIG. 3.

Figure 4:
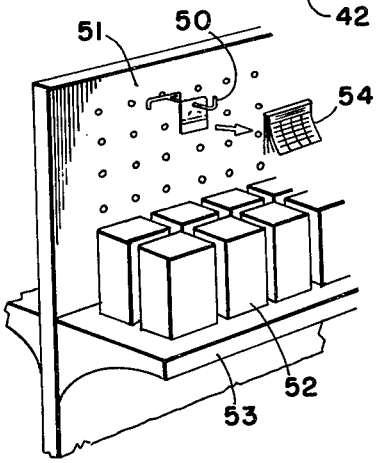
FIG. 4 is a fragmentary perspective view of the flexible pad holder and display in use on an aperture board.

Also, the upper section 12 is provided with a central hole 23 centered above the tab and near to but spaced from the upper edge 24 of the sheet 10. The purpose of the hole 23 is to support the flexible pad holder and display from a peg 10 or the like as seen in FIG. 4.

When the tab 15 is die cut from the sheet, it is noted that the legs 18 and 19 are somewhat weakened by relatively short slits seen at 26 and 27 extending outwardly from the bottom edge 16 of the tab. The legs are also further weakened by inwardly directed horizontally aligned slits seen at 28 and 29. The slits 28, 26, 27, and 29 are all horizontally aligned and aligned with the bottom edge 16 of the tab 15. In this manner, the sheet can readily be creased along such alignment and the bottom section 13 may then readily be broken away or removed from the top section 12.

The bottom section includes front and back rectangular adhesive pads seen at 32 and 33. Both pads may be provided with a coextensive peel-off cover as seen at 34.

Referring now to FIGS. 2 and 3, it will be seen that the upper section 12 of the flexible pad holder and display is designed to be snapped into a pricing channel seen at 36. Such pricing channels are generally mounted on the front edge of display shelves 37 and include a concave channel section 38 which includes a top depending flange 39 and a bottom coplanar upstanding flange 40. Such pricing channels are normally utilized for the insertion of identification and pricing information with respect to items displayed on the shelf thereabove. Pricing information or identification may be inserted in the pricing channels by snapping display information therein or sliding such information in from the end.

As can be seen from FIG. 2, the upper section 12 of the flexible pad holder and display may be snapped into the pricing channel by deflecting the tab 15 inwardly to snap behind the lower flange 40 while the upper edge 24 is positioned behind the top flange 37. This causes the upper section of the flexible pad holder and display to bow slightly outwardly as seen in FIG. 3. Nonetheless, the lateral legs 18 and 19 in cooperation with the bowed upper portion maintain the lower section 13 substantially in a vertical position. The legs 18 and 19, of course, extend in front of the channel flange 40 presenting the lower section in a dependent fashion below the pricing channel. The transparent nature of the material of the sheet 10 permits any pricing information displayed behind the flexible pad holder and display readily to be visible.

A flexible pad seen at 40 in FIGS. 2 and 3 includes a relatively stiff cardboard backing 41 and a plurality of tear-off sheets 42. The tear-off sheets are secured to the backing only through an adhesive connection to a top plastic layer 44 as in any pad of paper. The top edge of the backing 41 may be secured to the lower section 13 by simply peeling off the cover 34 and adhesively securing the pad in place as seen in FIG. 2. In this manner, the pad is supported in pendent fashion below the pricing channel without obscuring any information which may appear on the pricing channel. Moreover, the pad is supported by the outside or lateral legs 18 and 19 in a very stable fashion so that when a single sheet is removed from the pad, the stability of the item is insured and the holder will remain in the pricing channel.

As seen more clearly in FIG. 3, a second flexible pad indicated at 46 may be secured to the rear side of the lower section 13 in similar fashion. Thus, when the pad on the front side of the lower section is exhausted the display pad holder may simply be removed from the channel, turned around and reinserted in the channel with the tab 15 being displaced in the opposite direction. Thus, the lower section 13 may support two pads on both the front and back surfaces thereof, such pads facing in opposite directions.

It is noted that the construction of the sheet 10 with the configuration of the tab 15 permits the upper portion 12 to be distorted to fit within the pricing channel without significantly altering the planarity or vertical disposition of the lower section 13. It is also noted that the two lateral legs 18 and 19 provide greater stability for the lower section 13 and tend to preclude torsional twisting of the lower section when a sheet is torn from the pad as would otherwise occur if the lower section were supported from a central section of the sheet and conversely secured in the channel by two lateral lower flange engaging portions.

Referring now to FIG. 4, it will be seen that the hole 23 readily permits the flexible pad holder and display to be supported in hanging or pendent fashion from a peg or pin 50 mounted on an aperture board 51 above items 52 displayed on a shelf 53 therebeneath. The pad 54 may be secured adhesively to either the front or front and back sides of the lower section 13. As in connection with the pricing channel support, when the pad on the front side is depleted the flexible pad holder and display simply can be removed and reversed to present the opposite pad to the purchaser.

Figure 5:
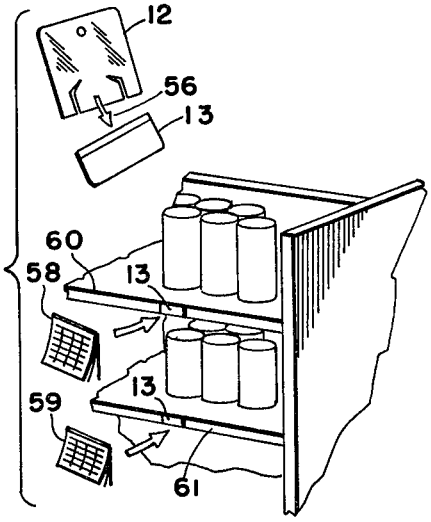
FIG. 5 is a similar view illustrating the bottom section of the flexible pad holder and display removed and used as a flexible pad holder on display shelves without a pricing channel.

Referring now to FIG. 5, it will be seen that the lower section 13 can readily be removed from the upper section 12 as indicated by the arrow 56. This may be accomplished simply by horizontally creasing the sheet 10 along a line aligned with the slits 28, 26, the bottom edge 16 of the tab, the lines 27 and 29. Such slits act as weakening perforations readily to permit the bottom section 13 to be removed from the top section 12.

Thus removed, the bottom section 13 can be used adhesively to secure flexible pads seen at 58 and 59 to the flat edge surfaces 60 and 61, respectively of the display shelf shown. This can be accomplished simply by peeling off the protective layer on the rear adhesive surface on the lower section 13, securing the same to the shelf 60 and then peeling off the front protective layer and securing the pad in the desired location.

Figure 6:
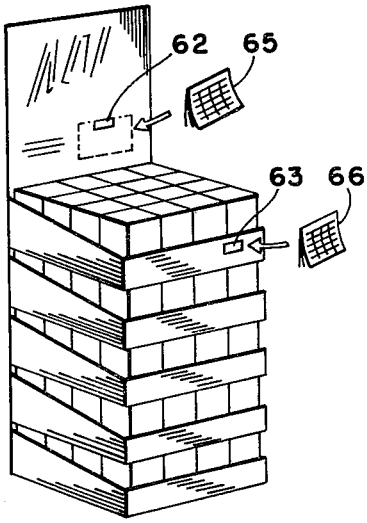
FIG. 6 is a view similar to FIG. 5 utilizing the removed bottom section of the flexible pad holder display to secure flexible pads to a cut box display.

Referring now to FIG. 6, there is illustrated a cut box display and the lower section 13 can be utilized in the same manner applied to any planar surface of the display as seen at 62 and 63. By peeling off the protective layer on one side of the lower section, the lower section may be applied to any vertical surface and then by peeling off the protective layer on the front side, the flexible pad may be applied at the desired location as seen at 65 and 66.

Thus, the lower section 13, when separated from the upper section has many applications in applying flexible pads or tear-off pads to substantially any vertical surface for display or advertising purposes.

It will also be appreciated that the separated upper section 12 has utility in and of itself as a price channel clip for an aperture board item to which pricing or other informational material can be secured as by writing or adhesive application.

It can now be seen that there is provided a low cost disposable flexible pad holder and display which includes an upper section and a lower section, the upper section including a central downwardly projecting tab having a horizontal edge adapted to be flexed to snap the upper section into a pricing channel in cooperation with the top edge of the holder, the lower section then being pendently supported from the upper section by lateral portions on each side of tab to provide stability for the flexible pad supported by the lower section. Score marks or slits are provided horizontally aligned with the lower edge of the tabs so that the upper section may readily be broken from the lower section, the lower section then being utilized with its adhesive pads to secure a flexible pad to a point of purchase sales location.

I claim:

1. A flexible pad holder and display comprising an upper section and a lower section, said upper section including a downwardly projecting tab having a horizontal lower free edge and downwardly extending side edges located inwardly of lateral portions of the upper section at respective sides of the tab, said tab being centrally located between side margins of said upper section and adapted to be flexed to snap the lower free edge into a pricing channel in cooperation with the top edge of the upper section, and the lateral portions pendently supporting the lower section from the upper section and cooperating to resist torsional twisting of the lower section as when a sheet is torn from a pad secured to the lower section.

2. A pad holder as set forth in claim 1 comprising adhesive pads on at least one front or rear surface of said lower section to which the flexible pad may be secured.

3. A pad holder as set forth in claim 1 including score marks horizontally aligned with the lower edge of said tab so that the upper section may readily be removed from the upper section.

4. A pad holder as set forth in claim 1 wherein said tab includes vertical and angularly inwardly directed side edges.

5. A pad holder as set forth in claim 1 comprising adhesive pads on both front and rear surfaces of said lower section.

6. A pad holder as set forth in claim 1 wherein said pad holder comprises a vertical sheet of flexible transparent plastic.

7. A pad holder as set forth in claim 1 including means readily to remove the upper section from the lower section.

8. A pad holder as set forth in claim 1 wherein said holder includes means to resist torsional twisting of the holder as a sheet is torn from the pad.

9. A pad holder as set forth in claim 1 including a hole in the upper central portion of the upper section so that said holder may be supported on a peg or pin.

10. A pad holder as set forth in claim 1 including means operative readily to separate the lower section from the upper section along the lower edge of said central tab.

11. A pad holder as set forth in claim 1 wherein said holder comprises a thin sheet of plastic material, said tab being constructed so that stressing of said tab from the plane of said sheet maintains the lower section in substantially the same plane as said sheet.

12. A pad holder as set forth in claim 1 including means to separate the upper section from the lower section horizontally aligned with the lower edge of the tab.

13. A pad holder as set forth in claim 1 including means readily to separate the upper section from the lower section.

14. A pad holder as set forth in claim 1 wherein said holder comprises a single sheet of flexible plastic material.

* * * * *